US006444052B1

(12) United States Patent
Honkura et al.

(10) Patent No.: US 6,444,052 B1
(45) Date of Patent: Sep. 3, 2002

(54) PRODUCTION METHOD OF ANISOTROPIC RARE EARTH MAGNET POWDER

(75) Inventors: Yoshinobu Honkura; Chisato Mishima, both of Chita (JP)

(73) Assignee: Aichi Steel Corporation, Tokai (JP)

( * ) Notice: Subject to any disclaimer, the term of this patent is extended or adjusted under 35 U.S.C. 154(b) by 0 days.

(21) Appl. No.: 09/417,134

(22) Filed: Oct. 13, 1999

(51) Int. Cl.[7] ..... H01F 1/055; H01F 1/057
(52) U.S. Cl. ..... 148/122; 148/101
(58) Field of Search ..... 148/101, 102, 148/122

(56) References Cited

U.S. PATENT DOCUMENTS

| | | | | |
|---|---|---|---|---|
| 4,981,432 A | | 1/1991 | Kikuchi | |
| 5,127,970 A | | 7/1992 | Kim | |
| 5,143,560 A | | 9/1992 | Doser | |
| 5,474,623 A | * | 12/1995 | Ma et al. | 148/101 |
| 5,486,239 A | * | 1/1996 | Nakayama et al. | 148/101 |
| 5,587,024 A | * | 12/1996 | Nakayama et al. | 148/101 |
| 5,851,312 A | | 12/1998 | Honkura et al. | |
| 6,056,830 A | * | 5/2000 | Honkura et al. | 148/122 |

FOREIGN PATENT DOCUMENTS

| | | | |
|---|---|---|---|
| JP | 3-129702 | | 6/1991 |
| JP | 3-129703 | | 6/1991 |
| JP | 3-146608 | | 6/1991 |
| JP | 4-17604 | | 1/1992 |
| JP | 4-133406 | | 5/1992 |
| JP | 4-133407 | | 5/1992 |
| JP | 5-163509 | | 6/1993 |
| JP | 5-163510 | | 6/1993 |
| JP | 6-128610 | | 5/1994 |
| JP | 6-302412 | | 10/1994 |
| JP | 7-54003 | | 2/1995 |
| JP | 7-76708 | | 3/1995 |
| JP | 7-76754 | | 3/1995 |
| JP | 7-68561 | | 7/1995 |
| JP | 7-278615 | | 10/1995 |
| JP | 7-110965 | | 11/1995 |
| JP | 7-331394 | | 12/1995 |
| JP | 8-288113 | | 11/1996 |
| JP | 9-165601 | | 6/1997 |
| JP | 9-251912 | * | 9/1997 |
| JP | 10-41113 | | 2/1998 |
| JP | 10-256014 | | 9/1998 |
| JP | 10-259459 | | 9/1998 |
| JP | 2838615 | | 10/1998 |
| JP | 2881409 | | 2/1999 |

OTHER PUBLICATIONS

Journal of Alloys and Compounds 231 (1995) 51–59, "Some applications of hydrogenation–decomposition–desorption–recombination (HDDR) and hydrogen–decrepitation (HD) in metals processing" Takuo Takeshita.
Journal of Japan Society of Powder and Powder Metallurgy vol. 46, No. 1, "Production of Nd–Fe–Co–B Magnet Powders having High $B_r$ by Modified HDDR Process" Morimoto et al.

* cited by examiner

*Primary Examiner*—John Sheehan
(74) *Attorney, Agent, or Firm*—Jacobson Holman, PLLC

(57) ABSTRACT

A production method to produce an anisotropic NdFeB based alloy magnet having a high anisotropic ratio and coercivity by a simple procedure. The production method consists of a first hydrogenation process, a second hydrogenation process and a desorption process. The first hydrogenation process at a low temperature produces the hydride that stores hydrogen needed in advance of the phase transformation. After that, the second hydrogenation process at an elevated temperature proceeds smoothly at a moderate reaction rate of the phase transformation and produces the mixture of $NdH_2$, Fe and $Fe_2$ B from the hydride in addition to making the crystallographic orientation of $Fe_2$ B phase consistent with the original $R_2$ $Fe_{14}$ B matrix phase. Subsequently, the desorption process produces the fine grained microstructure of $Nd_2$ $Fe_{14}$ BHx with high degrees of alignment of the crystallographic orientation consistent with the original crystallographic orientation of $Fe_2$ B phase. Fine and uniform grained microstructure of RFeB based alloy is produced by recombination of the mixture during the hydrogen heat treatment and consequently offers the anisotropic rare earth magnet powder to have a high anisotropic ratio and high coercivity.

16 Claims, 4 Drawing Sheets hydrogen heat treatment furnace

PRODUCTION METHOD OF ANISOTROPIC RARE EARTH MAGNET POWDER

FIELD OF THE INVENTION

The present invention relates to a production method of anisotropic rare earth magnet powder.

BACKGROUND OF THE INVENTION

A rare earth magnet, which is mainly composed of a rare earth element, boron and iron is widely used due to its excellent magnetic properties, such as coercivity and residual induction.

Rare earth magnet powder having good magnetic property can be produced by an elevated hydrogenation at the temperature of 750° C.–950° C. in which phase transformation in the rare earth magnet as raw material is induced by hydrogen absorption and subsequent hydrogen desorption in which reverse phase transformation is induced by hydrogen desorption.

Generally speaking, magnetic properties are estimated based upon the coercivity, residual induction and maximum energy product. The coercivity depends on the grain size in the microstructure of a magnet alloy. The fine grain size can improve the coercivity. On the other hand, the residual induction depends on the alignment of the crystallographic orientation of grains. High alignment increases the residual induction. Improvement of both the coercivity and the residual induction gives high maximum energy product.

Here, the inventors define the anisotropy as anisotropic ratio Br/Bs of more than 0.8, where Bs means the saturation induction which is equal to 16 kG and Br means residual induction. Br/Bs ratio of unity shows perfect anisotropy. The ratio of 0.5 shows ideal isotropy. An actual magnet takes only a medium ratio value from 0.5 to 1.0. If more than 0.8, the magnet is defined as an anisotropic magnet. If less than 0.6, it is defined as an isotropic magnet. If 0.6 to 0.8, it is a poor anisotropic magnet. By the way, practical applications of magnets require a coercivity of more than 9 kOe.

The production methods to improve magnetic property of magnets have been disclosed in the following patents.

Japanese Examined Patent Application Publication (Kokoku) No. 7-110965 discloses a production method characterized by hydrogen heat treatment which comprise hydrogenation and subsequent desorption. In this patent, the raw material is prepared through the process that RFeB based alloy is melted, cast into a ingot, crushed to powder and sintered or pressed into a block. Then, a lot of hydrogen is stored in the block under high hydrogen pressure. After that, heated at the temperature of 600° C. to 1000° C., hydrogenation reaction is carried out accompanied by the phase transformation from single $R_2$ $Fe_{14}$ B phase to a mixture of $RH_2$, Fe and $Fe_2B$. Subsequently desorption reaction accompanied by the reverse transformation is carried out to make a recombination phase.

However, there is a drawback that an inhomogeneous phase which is mixtured with fine grains and coarse grains appears because phase transformation takes place only in a partial area. The inhomogeneous phase causes too large a decrease in the coercivity to put the magnet in practical use. In addition, it is not good that this production method offers at most the anisotropic ratio of 0.7.

Japanese Examined Patent Publication (Kokoku) No. 7-68561 discloses an improved hydrogen heat treatment, in which, at first an ingot of NdFeB alloy is made, next a hydrogenation process accompanied by phase transformation is carried out in a manner to be heated at the temperature of 500° C. to 1000° C. under hydrogen pressure of more than 10 torr and then a desorption process accompanied by reverse phase transformation is carried out in the manner to be heated at the same temperature under vacuums of less than $10^{-1}$ torr.

This production method makes a fine recrystallized microstructure that gives high coercivity through phase transformation and subsequent reverse phase transformation. However, magnet powder that at most has a poor anisotropic ratio of 0.67 is obtained. This fact means that the hydrogen heat treatment accompanied by phase transformation and subsequent reverse phase transformation cannot produce anisotropic magnet powder having a high anisotropic ratio of more than 0.80.

The inventors of No. 7-68561 have been proceeding with their work up to the present to get excellent anisotropic magnet powder having a higher anisotropic ratio and have succeeded in inventing many advanced production methods.

At a beginning stage, Japanese Patent Application Laid-Open No. 3-129703 (1991) and No. 4-133407 (1992) were invented. These patents disclosed that when NdFeB based alloy including a large amount of Cobalt (Co) element and minor additive elements of Gallium (Ca), Zirconium (Zr), Titanium (Ti), Vanadium (V) and so on are subjected to the above mentioned hydrogen heat treatment, an anisotropic ratio of 0.75 at most can be obtained. These inventions give improvement in anisotropy ratio but have a big drawback that a large amount of Co element has to bring a high cost to magnet powder because the Co element is very expensive.

To solve the cost problem of the above inventions, Japanese Patent Application Laid-open No. 3-129702 (1991) and No. 4-133406 (1992) were invented. These patents disclosed that when NdFeB based alloys including minor additive elements of Ga, Zr, Ti, V without Co element are subjected to the above mentioned hydrogen heat treatment, an anisotropic ratio shows little improvement. But the improvement in anisotropy is insufficient since it gives only at most an anisotropic ratio of 0.68.

In addition, if the above mentioned hydrogen heat treatment is applied to mass production, there is a crucial barrier on controlling the temperature of hydrogen reaction, because the heat amount generated by its exothermic or endothermic reaction is proportional to the production volume. The deviation of the heat temperature from the optimum deteriorates the anisotropy of magnet powders considerably. To prevent the deterioration of anisotropy attributed to its exothermic or endothermic reaction in the mass production, the same inventors have produced five inventions. At first Japanese Patent Application Laid-open No. 3-146608 (1991) and No. 4-17604 (1992) were invented to disclose the mass production method where RFeB based alloy or RFeCoB based alloy are installed with heat storage material in the vessel. But this method gives only at most an anisotropic ratio of 0.69 which is far below the desirable anisotropic ratio of more than 0.80. So this method is not satisfied with the requirement to improve anisotropy of RFeB alloy.

Next, Japanese Patent Application Laid-open No. 5-163509 (1993) was invented to disclose a further advanced method where RFeB or RFeCoB based type ingots are homogenized and crushed into powder with uniform particle size. But this method also gives only at most an anisotropic ratio of 0.74, which means to give only a little improvement in anisotropy.

Furthermore, Japanese Patent Application Laid-open No. 5-163510 (1993) was invented to disclose a further advanced method where RFeB or RFeCoB based type ingots were subjected to the hydrogen heat treatment in the tubular vacuum furnace. But this method also gives only at most an anisotropic ratio of 0.74, so it is not satisfied.

Japanese Patent Application Laid-open No. 6-302412 (1994) was invented to disclose another technique where hydrogen pressure goes up and down during the hydrogen heat treatment of RFeB or RFeCoB type ingots. But this method also gives only at most an anisotropic ratio of 0.76. This method also is not sufficient.

It is clear that the above mentioned inventions cannot disclose production methods to get high anisotropy. So the inventors invented a more complicated technique that is disclosed in Japanese Patent Application Laid-open No. 8-288113 (1996), where the above mentioned hydrogen heat treatment of RFeB or RFeCoB type ingots are carried out, and subsequently a similar hydrogen heat treatment is repeated which comprises hydrogenation under the hydrogen pressure of 1 torr to 760 torr at low temperature of less than 500° C. and subsequent desorption under vacuum at the temperature of 500° C. to 1000° C. This technique improves the anisotropy due to the decrease of internal stress or intergranular rapture of $Nd_2$ $Fe_{14}$ B matrix phase as well as R-rich phase or B-rich phase that are made brittle. An this method gives an anisotropic ratio of at most 0.84, which exceeds the desirable anisotropic ratio of more than 0.80. However, this method needs a too long processing time because of twice hydrogen heat treatment. In other words, this method is too complicated to carry out mass production.

Japanese Patent Application Laid-open No. 10-041113 (1998) discloses another complicated method where on the partway of the hydrogen heat treatment, RFeCoB type ingots are rapid cooled after hydrogen is changed by argon gas and again heated under hydrogen atmosphere to make hydrogen absorption followed by hydrogen desorption. This method is characterized by the formation of R(FeCoM)2 phase but it gives only an anisotropic ratio of at most 0.69. This method also is not sufficient.

Japanese Patent Application Laid-open No. 10-259459 (1998) discloses a more complicated method where the matrix phase and the precipitation phase along grain boundaries of RFeCoNiB type ingots are controlled by casting technique and the cooling rate after hydrogen heat treatment. This method gives an anisotropic ratio of at most 0.80. However, this method is too difficult to mass produce in the conventional casting technique.

Recently the inventors discovered the remarkable effect of Magnesium (Mg) addition of about 0.1 at % on anisotropy of magnet powder produced by the hydrogen heat treatment which is disclosed in Japanese Patent Application Laid-open No. 10-256014 (1998). But since Mg element has a melting point of 650° C. and a boiling point of 1120° C., it is very difficult to control its addition amount with high accuracy.

Summing up the above, although the inventors of No. 7-68561 have been proceeding to get high anisotropy, they have not succeeded in producing an excellent anisotropic RFeB based magnet powder with no addition of Co element by uncomplicated production methods which make mass production possible. In other words, their inventions need an addition of Co element or complicated production techniques, which result in making too expensive magnet powders.

Other inventors invented six inventions filed as Japanese Patent Application Laid-open No. 6-128610 (1994), No. 7-54003 (1995), No. 7-76708 (1995), No. 7-76754 (1995), No. 7-278615 (1995) and No. 9-165601 (1997), which disclose production methods to get a high anisotropic ratio of at most 0.83. In these patents, RFeB or RFeCoB type ingots are crushed and then heated up to the temperature of more than 750° C., followed by holding under hydrogen pressure of 10 Pa to 1000 Pa at the temperature of 750° C. to 900° C. to make the disproportionated mixture composing $NdH_2$, Fe and $FeB_2$. At the same time, the undisproportionated phase of the original $Nd_2$ $Fe_{14}$ B matrix remains as the finely dispersed crystallites maintaining the original crystallographic orientation and functions to reproduce the original crystallographic orientation in the recombined $Nd_2$ $Fe_{14}$ B matrix phase. However, this method requires a suitable amount of undisproportionated phase which is formed under transient phenomena, and the mass production is very difficult. In fact, the commercial production applied by the present method is not established up to now. Moreover, it is required that the addition of Co and Ga is essentially important to form the undisproportionated phase, which means the drawback of this production method is the high amounts of Co which leads to high cost.

The review in J. Alloys and Compounds 231 (1995) 51 on the study about the anisotropy produced by the hydrogen heat treatment written by one of the inventors of No. 7-68561, reported that the hydrogen heat treatment is characterized by the HDDR (Hydrogenation, Decomposition, Desorption and Recombination) process, in which the original NdFeB matrix is decomposed into a mixture of $NdH_2$, Fe and $FeB_2$ by hydrogenation and subsequent desorption makes recombination of the mixture to reproduce the submicron microstructure of $Nd_2$ $Fe_{14}B$ matrix phase. The HDDR process applied to the ternary NdFeB alloy improves the coercivity due to the formation of the fine microstructure but only makes an isotropic magnet. However, the substitution of Fe with Co in the ternary NdFeB alloy and additions of certain elements such as Zr, Ga, or Hafnium (Hf) show the remarkable effect on producing anisotropic magnet under the HDDR process. Here, it is insisted that the addition of Co element is essential to produce high anisotropy of NdFeB alloy. The above opinion about the HDDR process is well recognized as a reputed view in this field.

From the above discussion, it is determined that the most important concern is to require a large addition of Co element in an NdFeB alloy leading to high cost.

The Problem to be Solved by the Invention

The object of the invention is to provide a production method to produce an anisotropic NdFeB based alloy magnet with no addition of Co element.

Means of Solving the Problem

Through an intensive study about the hydrogen heat treatment, we have discovered that the NdFeB based alloy with no addition of Co element can have high degrees of anisotropy by the following hydrogen heat treatment.

At first, the NdFeB based alloy ingot prepared as the raw material is subject to the first hydrogenation at low temperature. The NdFeB based alloy absorbs hydrogen below the temperature of less than 600° C. under high hydrogen pressure to become a hydride of $Nd_2$ $Fe_{14}$ BHx which stores enough hydrogen to induce the disproportation reaction. Then the hydride is subject to the second hydrogenation at an elevated temperature. In the process, the hydride is heated up at the temperature of 760° C. to 860° C. for disproportation reaction under the suitable hydrogen pressure which supplies hydrogen to be required by the disproportation reaction after consuming the stored hydrogen. As a result, the phase transformation to produce a mixture of $NdH_2$, Fe and $Fe_2B$ proceeds smoothly with the suitable reaction rate that forms $Fe_2B$ phase to have the original crystallographic orientation. (Here FIG. 1 shows the consistency of the crystallograhic orientation of both $Fe_2B$ phase and the original $Nd_2Fe_{14}B$ matrix phase.)

After that, the desorption process is carried out for recombining the mixture so as to form NdFeB with a submicron grain size of about 0.3 $\mu$m. At the first stage of desorption, the reverse phase transformation proceeds as smooth as possible by holding at the hydrogen pressure as high as the desorption reaction can be kept. The recombined $Nd_2$ $Fe_{14}$ B matrix phase grows in keeping its crystallographic orientation in consistency with the crystallographic orientation of $Fe_2B$. It is noted that the alloy becomes the hydride of $Nd_2$ $Fe_{14}$ BHx again since a lot of hydrogen remains in the alloy. (Here, FIG. 1 shows the consistency of the crystallographic orientation of both Fe 2 B phase and the recombined $Nd_2$ $Fe_{14}$ B matrix phase.) Subsequently, the hydrogen is desorbed fully from the alloy under a high vacuum.

The recombined $Nd_2$ $Fe_{14}$ B matrix phase has a high degree of alignment of the crystallographic orientation of grains in the consistency with the original crystallographic orientation to give high anisotropy to the magnet. At the same time, the phase has a fine and uniform grained microstructure to make high coercivity.

The hydrogen heat treatment of the present invention has no need of Co element addition and is suitable for mass production because of no application with transient phenomenon that allows the remnant of NdFeB phase.

For the first time, the present invention disclosed an advanced hydrogen heat treatment to produce the anisotropic magnet powder of NdFeB based alloy with no addition of Co element.

The anisotropic magnet powder that has excellent magnetic properties is useful to produce the anisotropic bonded magnet.

The present production method to produce the anisotropic magnet powder consists of the first hydrogenation at a low temperature and the second hydrogenation at an elevated temperature and subsequent hydrogen desorption.

RFeB based alloy is mainly composed of rare earth element including yttrium (Y), iron (Fe) and born (B) with unavoidable impurity. Here, R can be one or more rare earth elements chosen from the group of Y, lanthanum (La), cerium (Ce), praseodymium (Pr), neodymium (Nd), samarium (Sm), gadolinium (Gd), terbium (Tb), dysprosium (Dy), holmium (Ho), erbium (Er), thulium (Tm) and lutetium (Lu). It is desirable to choose Nd as the R element due to its low cost and potential of offering superior magnetic properties of its alloy.

It is preferable to add 0.01–1.0 at % of Ga or 0.01–0.6 at % of niobium (Nb) into RFeB based alloy to enhance the magnetic property. Addition of 0.01–1.0 at % of Ga enhances the coercivity of the anisotropic magnet powder. However, Ga of less than 0.01 at % cannot improve the coercivity, and Ga of more than 1.0 at % can cause a decrease in the coercivity. Addition of 0.01–0.6 at % of Nb has a great effect on the reaction ratio of the phase transformation or the reverse phase transformation. But Nb of less than 0.01 at % has little or no effect on the reaction ratio and Nb of more than 0.6 at % cause decrease of the coercivity.

It is preferable to add one or more transition metals chosen from Al, Si, Ti, V, Cr, Mn, Ni, Cu, Ge, Zr, Mo, In, Sn, Hf, is Ta, W, Pb with a total additive amount of 0.001 at % to 5.0 at %.

Additions of these elements can enhance the coercivity and the aspect ratio of a magnet. But additions of less than 0.001 at % has little or no effect on the magnetic properties and additions of more than 5.0 at % causes a decrease of the coercivity due to appearance of an unfavorable precipitation phase.

It is possible to add 0.001–20 at % of Co element into a RFeB based alloy. Addition of Co element increases the Curie temperature of the alloy to enhance the elevated magnetic property.

But addition of less than 0.001 at % Co shows little or no effect on the magnetic properties and addition of more than 20 at % Co causes a decrease of the residual induction to deteriorate the magnetic property.

RFeB based alloy has a matrix phase of $R_2$ $Fe_{14}$ B intermetalic compound.

The preferable composition of RFeB based alloy has 12–15 at % R, 5.5–8 at % B and the balance of Fe with unavoidable impurity. R of less than 12 at % causes decrease in the coercivity (iHc) due to appearance of Fe phase, and R of more than 15 at % causes decrease in the residual induction (Br) due to the decrease of $R_2$ $Fe_{14}$ B phase. B of less than 5.5 at % causes decrease in the coercivity (iHc) due to appearance of soft magnetic $R_2$ $Fe_{17}$ phase, and B of more than 15 at % causes decrease in the residual induction (Br) due to the decrease of $R_2$ $Fe_{14}$ B phase.

The raw material of the present invention is prepared as an ingot or powder by the conventional process in which the prescribed amount of purified rare earth elements, iron and born are jointly melted in a high frequency furnace or a melting furnace, and then cast into an ingot, followed by crushing into powder. It is desirable that the raw materials are homogenized to decrease the segregation of alloy elements in ingots.

The first hydrogenation produces a hydride ($Nd_2$ $Fe_{14}$ BHx) from RFeB based alloy by holding the raw material in a furnace kept at the temperature of less than 600° C. under high hydrogen pressure.

Plenty of hydrogen is stored in the alloy by the first hydrogenation and control of the reaction rate of the phase transformation in the subsequent hydrogenation. Here, index of X means stoichiometry of hydrogen in the hydride. The value of x increases in proportion to the hydrogen pressure and reaches the saturation value at a long holding time in the furnace.

It is preferable that RFeB based alloy is held for 1–3 hours under the hydrogen pressure of more than 0.3 atm. The hydrogen pressure of less than 0.3 atm is not preferable at which the hydrogenation reaction to make a hydride ($Nd_2$ $Fe_{14}$ BHx) proceeds only insufficiently or needs too long a holding time. The hydrogen pressure of 0.3–1.0 atm is desirable at which the hydrogenation reaction proceeds fully. The hydrogen pressure of more than 1.0 atm is not desirable but acceptable. Here, not only hydrogen gas but also a mixed gas with hydrogen and inert gas such as argon is applied as the hydrogen atmosphere. The hydrogen pressure of the mixed gas means the partial pressure of hydrogen. The temperature of more than 600° C. is undesirable because of the decrease in the magnetic property due to occurrence of the phase transformation in a partial portion.

The hydride of $Nd_2$ $Fe_{14}$ BHx produced in the first hydrogenation has the crystallographic orientation the same as the original crystallographic orientation of a matrix phase of $R_2$ $Fe_{14}$ B.

The second hydrogenation produces a disproportionated mixture of $NdH_2$, Fe and $Fe_2B$ through the phase transformation by heating the hydride of $Nd_2$ $Fe_{14}$ BHx at the temperature of more than 600° C. under hydrogen pressure of 0.2–0.6 atm. In this process, $Fe_2$ B phase is formed to have the original crystallographic orientation.

In the process where the raw material treated is the hydride, the phase transformation consumes the stored hydrogen in the alloy, and a want of hydrogen is supplied from the outside hydrogen gas. The phase transformation proceeds at a moderate rate to be completed under the low hydrogen pressure, which results in producing a uniform mixture of three phases including $Fe_2$ B phase with the original crystallographic orientation. Here, the phase transformation is defined as the disproportation reaction to change a hydride of $Nd_2Fe_{14}$ BHx to a mixture of $NdH_2$, Fe and $Fe_2$ B with assistance of the outside hydrogen gas.

The second hydrogenation is allowed to put a hydride of $Nd_2$ $Fe_{14}$ BHx into the furnace to be heated up in advance of the phase transformation temperature. The preferable condition in the second hydrogenation is to keep the hydrogen pressure within 0.2–0.6 atm and the temperature within 760° C.–860° C. Because the hydrogen pressure within 0.2–0.6 atm can induce the phase transformation proceeding at a moderate rate. The hydrogen pressure of less than 0.2 atm exists as a remnant of the hydride of $Nd_2$ $Fe_{14}$ BHx that has the remarkable effect on a decrease in the coercivity. In contrast, the hydrogen pressures of more than 0.6 atm force the phase transformation to proceed at a high rate so as to disturb the consistency of the crystallographic orientation with both $Fe_2$ B phase and the original hydride of $Nd_2$ $Fe_{14}$ BHx. Consequently the remarkable decrease in the anisotropic ratio is caused. The treatment temperature of less than 760° C. can induce the phase transformation perfectly but unhomogeneously to form a unhomogeneous mixture that causes a decrease in the coercivity. At the temperature of more than 860° C., growth of grain size occurs to cause the decrease in the coercivity.

Here it is noted that since the phase transformation reaction is exothermic, there is a difficulty to apply the hydrogen heat treatment to mass production. The progress of the reaction is accompanied with generation of heat that increases the temperature of the raw material and accelerates the reaction rate. Moreover since the reaction absorbs the outside hydrogen gas, the hydrogen pressure is decreased. Therefore, in order to control the reaction rate, a special furnace such as the furnace disclosed in the Japanese Patent Application Laid-open (Kokai) No. 9-251912 is needed to have proper control of the temperature and the hydrogen pressure.

As previously mentioned, since the rate of the phase transformation is considered to be proportional to the reaction rate with the alloy and hydrogen, the former is estimated by the latter. There is a suitable reaction rate to offer a high degree of anisotropy. The rate produces $Fe_2B$ phase with the original crystallographic orientation in a uniform mixture of $NdH_2$, Fe and $Fe_2$ B. Since the reaction rate depends on the treated temperature and the hydrogen pressure accompanied with interaction of both factors, it is preferable that the reaction rate is controlled by both factors in combination.

It is important that the suitable reaction rate is within 0.05–0.80 of the relative reaction rate is defined as follows.

As well known, the reaction rate of V with the alloy and hydrogen is defined as:

$$V=V_0\cdot(P_{H2}/P_0)^{1/2}-1)\cdot\exp(-Ea/RT) \quad (1)$$

where $V_0$ is frequency factor, $P_{H2}$ is hydrogen pressure, $P_0$ is dissociation pressure, Ea is activation energy of the alloy, R is gas constant T is absolute temperature of the system.

The relative reaction rate of Vr is defined as the ratio of reaction rate V to the normal reaction rate Vb, which is given as the rate of the reaction to proceed at the temperature of 830° C. under a hydrogen pressure of 0.1 Mpa.

Therefore $$Vr=V/Vb=1/0.576(((PH_2)^{1/2}-0.39)/0.61)\cdot\exp(-Ea/RT)\cdot10^{-9} \quad (2)$$

The relative reaction rate of less than 0.05 causes the remarkable decrease in the coercivity due to the remnant of the hydride. In contrast, the relative reaction rates of more than 0.80 cause a remarkable decrease in the anisotropic ratio due to the disturbance of the alignment of the crystallographic orientation.

The next process is desorption which consists of the first stage of desorption and the second stage of desorption. The first stage is intended to produce the fine grained microstructure of the hydride $Nd_2$ $Fe_{14}$ BHx with the original crystallographic orientation by controlling the reaction rate of the reverse phase transformation at the hydrogen pressure of 0.001–0.1 atm. The second stage is intended to produce the fine-grained microstructure of $Nd_2$ $Fe_{14}$ B matrix phase by hydrogen elimination from the alloy under a high vacuum of less than 10–2 torr.

In the first stage of desorption, the reverse phase transformation proceeds smoothly under the hydrogen pressure of 0.001–0.1 atm. As a result, the crystallographic orientation of the hydride $Nd_2$ $Fe_{14}$ BHx is consistent with $Fe_2$ B to keep the original crystallographic orientation. In the second stage of desorption, the fine grained microstructure of the $Nd_2$ $Fe_{14}$ B matrix phase is formed from the hydride by elimination of the remanent hydrogen. It is natural that there is the consistency with hydride $Nd_2$ $Fe_{14}$ BHx and the $Nd_2$ $Fe_{14}$ B matrix phase on the crystallographic orientation to keep the original crystallographic orientation.

The pressures of more than 0.1 atm can not force to separate hydrogen from $RH_2$ phase in the mixture. The pressures of less than 0.001 atm cause rapid separation of hydrogen from $RH_2$ phase in the mixture and simultaneously make the rate of the reverse phase transformation too large, which results in the decrease of the anisotropic ratio of the magnet powder obtained after this treatment. Here, a preferable holding time of the first stage of desorption is within 10 min–120 min. The time needed to complete the reaction of the reverse phase transformation is supposed to be about 10 min. Actually it depends on treatment volume. The holding time of less than 10 min causes the decrease in the residual induction due to the remnant of the mixture in partial portion. The holding time of more than 120 min cause the decrease in the coercivity due to the extreme growth of grains in local site.

In the second stage of desorption, the hydrogen pressure of more than $10^{-2}$ torr makes hydrogen remain in the alloy the cause the decrease in the coercivity of the magnet powder.

Here it is noted that since the reverse phase transformation reaction is endothermic, there is difficulty in the desorption process similar to the hydrogenation process. The progress of the reaction is accompanied with exhaust of heat that decrease the temperature of the raw material remarkably. Moreover the reaction desorbs the stored hydrogen to the outside so as to increase the hydrogen pressure, which may bring a stop to the reaction. Therefore, in order to control the reaction rate, a special furnace such as the furnace disclosed in the Japanese Patent Application Laid-open (Kokai) No. 9-251912 is needed to have proper control of the temperature and the hydrogen pressure.

Similarly with the rate of the phase transformation, the rate of the reverse phase transformation is considered to be proportional to the reaction rate with the alloy and hydrogen. There is a suitable reaction rate to offer a high degree of anisotropy. The rate produces RFeB phase from the mixture of $NdH_2$, Fe and $Fe_2$ B with good alignment of crystallographic orientation in consistency with the original crystallographic orientation. Since the reaction rate depends on the treated temperature and the hydrogen pressure accompanied with interaction of both factors, it is preferable that the reaction rate is controlled by both factors in combination. It is important that the suitable reaction rate is within 0.10–0.95 of the relative reaction rate that is defined in a similar manner with the reaction rate and the relative reaction rate of the hydrogen absorption. Therefore $$V=VO\cdot(1-(P_{H2}/P_0)^{1/2})\cdot\exp(-Ea/RT) \quad (3)$$

Here, $P_{H2}$ performs as a potential of the reverse phase transformation reaction.

The relative reaction rate Vr of the hydrogen desorption is defined as the ratio of reaction rate V to the normal reaction rate Vb, which is given as the rate of the reaction to proceed at the temperature of 830° C. under a hydrogen pressure of $10^{-1}$ torr.

Therefore $$Vr=V/Vb=1/0.576\cdot(0.39-(P_{H2})^{1/2})/0.38)\cdot\exp(--Ea/RT)\cdot10^{-9} \quad (4)$$

The relative reaction rate of less than 0.1 needs such a long treatment time to become an inhomogeneous microstructure due to imbalance in nucleation and growth. On the other hand, the relative reaction rate of more than 0.95 provides poor consistency in the crystallographic orientation with the $Fe_2$ B phase and the recombined $R_2$ $Fe_{14}$ B matrix phase causing a decrease in the anisotropic ratio.

The anisotropic magnet powder produced by the present production method is used in an anisotropic bonded magnet. It also is applied to an anisotropic full dense magnet produced by sintering or hot pressing.

The production method disclosed in the present invention offers anisotropic rare earth magnet powder to have a high anisotropic ratio and high coercivity. This method consists of a first hydrogenation process, a second hydrogenation process and a desorption process. The first hydrogenation process at a low temperature produces the hydride that stores hydrogen needed in advance of the phase transformation. Next the second hydrogenation process at an elevated temperature proceeds smoothly at a moderate reaction rate of the phase transformation and produces the mixture of $NdH_2$, Fe and $Fe_2$ B from the hydride, in addition to making the crystallographic orientation of $Fe_2B$ phase consistent with the original $R_2$ $Fe_{14}$ B matrix phase. In the desorption process, the first stage of desorption produces fine grained microstructure of $Nd_2$ $Fe_{14}$ BHx which is consistent with the original crystallographic orientation of the $R_2$ $Fe_{14}$ B matrix phase and the second stage of desorption eliminates the remanent hydrogen in the recombined $Nd_2$ $Fe_{14}$ BHx. As a result the fine and uniform grained microstructure of RFeB based alloy with high degrees of alignment of the crystallographic orientation is made to offer the anisotropic rare earth magnet powder having high anisotropic ratio and high coercivity.

DESCRIPTION OF THE PREFERRED EMBODIMENTS

Figure 1:
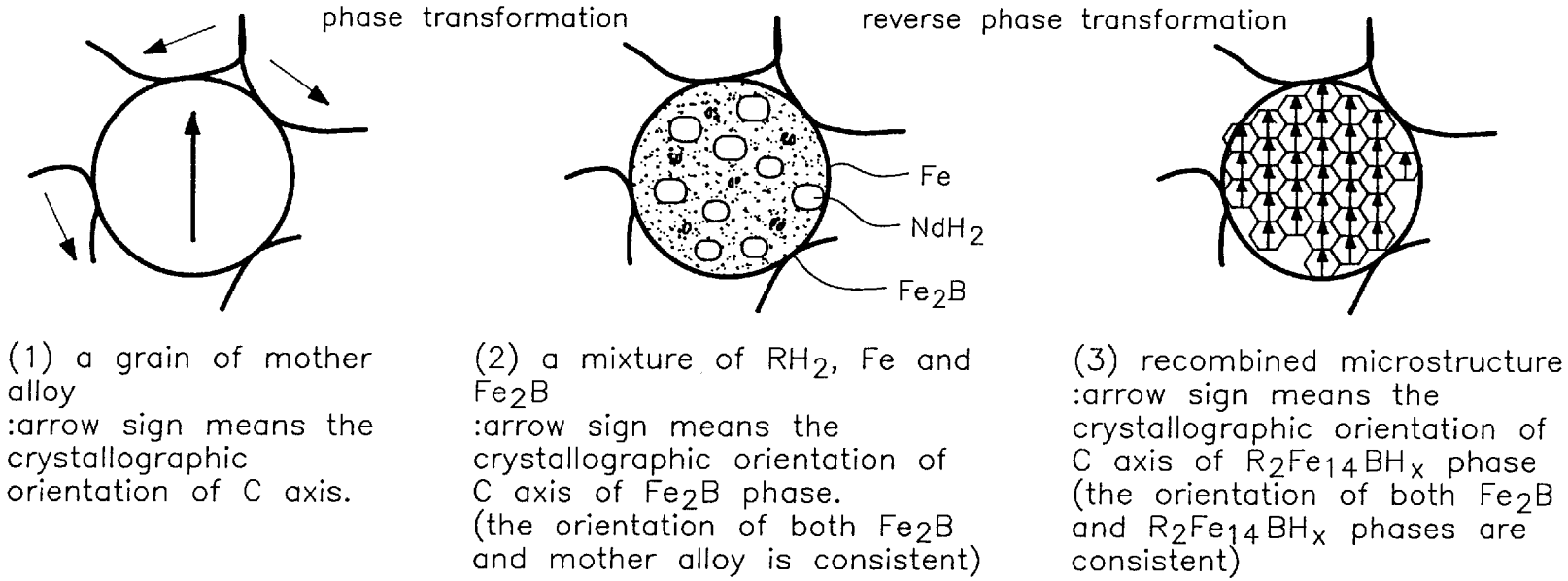
FIG. 1 is a graph conceptually showing how to transfer the original crystallographic orientation of original RFeB phase through a finely dispersed $Fe_2B$ phase to the fine grained microstructure of RFeB recombined with good consistency.

The following embodiments accurately explain the present invention.

In the embodiments the anisotropic magnet powder is made of NdFeB based alloy that is chosen from RFeB based alloy.

Embodiment (1)

The anisotropic magnet powder is produced by the present hydrogen heat treatment in which NdFeB based alloy with the desired composition is cast in an ingot, and forms the hydride $Nd_2$ $Fe_{14}$ BHx. The anisotropic magnet powder is formed from the hydride by the phase transformation and subsequent reverse phase transformation.

The details of the present hydrogen heat treatment are as follows:

The raw materials of a designated amount of Nd, Pr, Dy, B, Ga, Nb and Fe are melted in a high frequency furnace having a capacity of 100–300 Kg per batch and cast into ingots of the compositions shown in Table 1. After that the ingots are heated and homogenized for 40 hours at the temperature of 1140–1150° C. under argon gas. The content of the alloy elements are shown by atomic percent (at %), and residual at % of Fe.

| sample | composition | | | | | | | | | | | | | | | | | | | | | | | | |
|---|---|---|---|---|---|---|---|---|---|---|---|---|---|---|---|---|---|---|---|---|---|---|---|---|---|
| | chemical composition (a t %) | | | | | | | | | | | | | | | | | | | | | | | | |
| No. | Nd | Pr | Dy | Fe | Ga | Nb | B | Al | Si | Ti | V | Cr | Mn | Co | Ni | Cu | Ge | Zr | Mo | In | Sn | Hf | Ta | W | Pb |
| a | 12.5 | — | — | bal. | — | — | 6.4 | — | — | — | — | — | — | — | — | — | — | — | — | — | — | — | — | — | — |
| b | 12.5 | — | — | bal. | 0.3 | 0.2 | 6.4 | — | — | — | — | — | — | — | — | — | — | — | — | — | — | — | — | — | — |
| c | 12.8 | 0.2 | — | bal. | 0.1 | 0.1 | 6.4 | — | — | — | — | — | — | — | — | — | — | — | — | — | — | — | — | — | — |
| d | 12.2 | 0.1 | 0.1 | bal. | 0.3 | 0.3 | 7.0 | — | — | — | — | — | — | — | — | — | — | — | — | — | — | — | — | — | — |
| e | 13.0 | — | — | bal. | 0.25 | 0.25 | 8.0 | — | — | — | — | — | — | — | — | — | — | — | — | — | — | — | — | — | — |
| f | 12.7 | 0.2 | — | bal. | 0.3 | 0.4 | 6.2 | — | — | — | — | — | — | — | — | — | — | — | — | — | — | — | — | — | — |
| g | 15.0 | 0.2 | 0.1 | bal. | 0.2 | 0.2 | 7.1 | — | — | — | — | — | — | — | — | — | — | — | — | — | — | — | — | — | — |
| h | 12.4 | 1.0 | — | bal. | 0.3 | 0.2 | 6.5 | — | — | — | — | — | — | — | — | — | — | — | — | — | — | — | — | — | — |
| i | 12.1 | 0.2 | — | bal. | 0.5 | 0.1 | 6.6 | — | — | — | — | — | — | — | — | — | — | — | — | — | — | — | — | — | — |
| j | 12.3 | — | — | bal | 0.3 | 0.2 | 6.4 | — | — | — | — | — | — | 5.0 | — | — | — | — | — | — | — | — | — | — | — |

-continued

| sample | composition | | | | | | | | | | | | | | | | | | | | | | | |
|---|---|---|---|---|---|---|---|---|---|---|---|---|---|---|---|---|---|---|---|---|---|---|---|---|
| | chemical composition (a t %) | | | | | | | | | | | | | | | | | | | | | | | |
| No. | Nd | Pr | Dy | Fe | Ga | Nb | B | Al | Si | Ti | V | Cr | Mn | Co | Ni | Cu | Ge | Zr | Mo | In | Sn | Hf | Ta | W | Pb |
| k | 12.5 | — | — | bal | — | — | 6.5 | — | — | — | 0.2 | — | — | 5.0 | — | — | — | — | — | — | — | — | — | — | — |
| l | 12.7 | — | — | bal. | — | — | 6.2 | — | — | — | — | 0.1 | — | 7.0 | — | — | — | — | — | — | — | — | — | — | — |
| m | 13.0 | — | — | bal. | — | — | 6.1 | — | — | — | — | — | 0.2 | 10 | — | — | — | — | — | — | — | — | — | — | — |
| n | 12.2 | — | — | bal | — | — | 7.0 | — | — | — | — | — | — | 5.0 | 0.5 | — | — | — | — | — | — | — | — | — | — |
| o | 12.6 | — | — | bal. | — | — | 6.3 | 1.0 | — | — | — | — | — | — | — | — | — | 0.2 | — | — | — | — | — | — | — |
| p | 13.1 | — | — | bal | — | — | 7.2 | — | 0.5 | — | — | — | — | — | — | — | 0.1 | — | — | — | — | — | — | — | — |
| q | 12.5 | — | — | bal | — | — | 6.5 | — | — | 0.05 | — | — | — | — | — | — | — | — | — | — | — | — | — | — | — |
| r | 12.8 | — | — | bal | — | — | 6.2 | — | — | — | 0.1 | — | — | — | — | — | — | — | — | — | — | — | — | — | — |
| s | 12.5 | — | — | bal. | — | — | 6.3 | — | — | — | — | 0.2 | — | — | — | — | — | — | — | — | — | — | — | — | — |
| t | 12.7 | — | — | bal. | — | — | 6.7 | 0.8 | — | — | — | — | 0.2 | — | — | — | — | — | — | — | — | — | — | — | — |
| u | 12.9 | — | — | bal. | — | — | 6.4 | — | — | — | — | — | — | — | — | 0.3 | — | — | — | — | — | — | — | — | — |
| v | 12.1 | — | — | bal. | — | — | 6.3 | — | — | — | — | — | — | 3.0 | — | — | 0.5 | — | — | — | — | — | — | — | — |
| w | 12.3 | — | — | bal. | — | — | 6.7 | — | — | — | — | — | — | — | — | — | — | — | 0.2 | — | — | — | — | — | — |
| x | 12.9 | — | — | bal | — | — | 7.0 | — | — | — | — | — | — | — | — | — | — | — | — | 0.05 | — | — | — | — | — |
| y | 13.4 | — | — | bal. | — | — | 6.5 | — | — | — | — | — | — | — | — | — | — | — | — | — | 0.01 | — | — | — | — |
| z | 12.8 | — | — | bal | — | — | 7.0 | — | — | — | — | — | — | 20 | — | — | — | — | — | — | — | 0.1 | — | — | — |
| aa | 12.4 | — | — | bal | — | — | 6.5 | — | — | — | — | — | — | — | — | — | — | — | — | — | — | — | 0.1 | — | — |
| bb | 12.5 | — | — | bal | — | — | 8.1 | — | — | — | — | — | — | — | — | — | — | — | — | — | — | — | — | 0.1 | — |
| cc | 12.3 | — | — | bal. | — | — | 7.1 | — | — | — | — | — | — | — | — | — | — | — | — | — | — | — | — | — | 0.2 |
| dd | 12.4 | — | — | bal. | 0.3 | 0.2 | 6.1 | 0.5 | — | — | — | — | 0.1 | — | 0.2 | — | — | — | — | — | — | — | — | — | — |
| ee | 12.5 | — | — | bal. | 0.3 | 0.2 | 7.4 | — | — | — | 0.1 | 0.1 | — | — | — | — | — | — | — | — | — | 0.1 | — | — | — |

Figure 2:
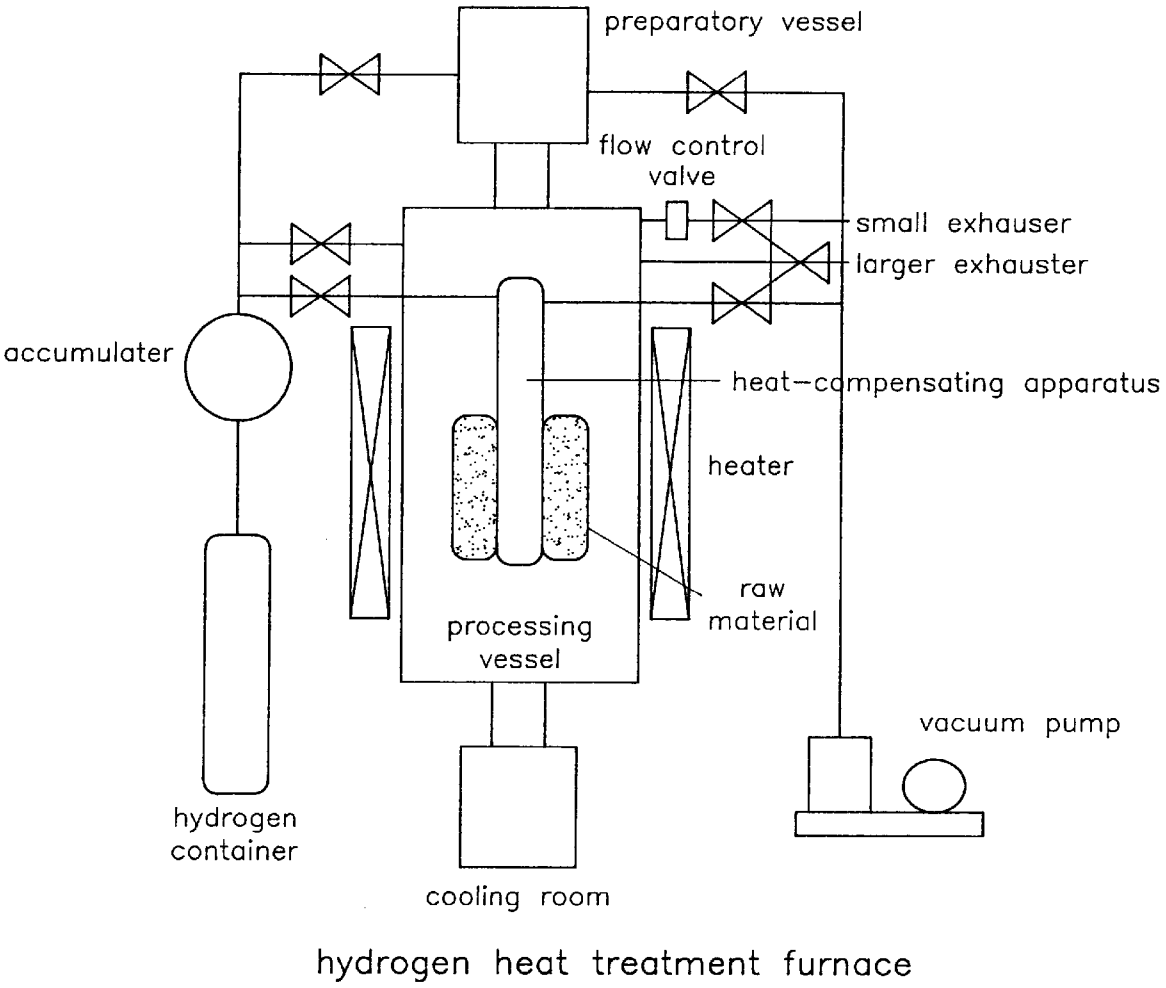
FIG. 2 is a graph conceptually showing a novel hydrogen furnace furnished with a processing vessel and a heat compensating vessel to easily control the reaction rate of hydrogenation or desorption.

The homogenized ingots are crushed into coarse powder with average particle sizes of less than 10 mm, and are placed under hydrogen in the preparatory vessel, as shown in FIG. 2. This airtight vessel is furnished with both a supplier of hydrogen gas and a vacuum pump to have the ability to control the hydrogen pressure.

The above coarse powders are treated for a holding time of 3 hours, with more than 0.5 hour being acceptable, at the room temperature under the hydrogen pressure shown in Table 2, and is formed into hydrides by the reaction with the powder and hydrogen. The formations of the hydride were observed easily by decreases of the hydrogen pressure. Here, sample number (No.) of 1 to 9 correspond to chemical composition of "a" to "i" respectively.

The hydride is conveyed from the preparatory vessel to the processing vessel without exposure to the air. Both vessels are joined together and furnished with both a supplier of hydrogen gas and a vacuum pump to have the ability to control the hydrogen pressure. The processing vessel is furnished with a heater and a heat-compensating apparatus, which can cancel the heat generated during the processing by the phase transformation that is exothermic. In the heat-compensating apparatus, the reverse phase transformation that is endothermic is forced to progress synchronously in the heat-compensating vessel to absorb the heat. As a result, the temperature of the raw material is kept constant and the reaction rate is controlled within the suitable rate. In contrast, the desorption process demands the reverse operation of the furnace.

The hydride that is subject to the second hydrogenation is changed to the mixture of $NdH_2$, Fe and $Fe_2$ B by the phase transformation. Since the relative reaction rates of the phase transformation are set within the desirable range shown in Table 2, the $Fe_2$ B phase can have the crystallographic orientation consistent with the original $Nd_2Fe_{14}$ B matrix phase. Here, the holding times of the second hydrogenation are more than 3 hours.

After that, the desorption process is carried out by two exhausters which are of the small type and the large type. The first stage of desorption is carried out by the small exhauster to keep the hydrogen pressure within 0.001–0.05 atm using a flow control valve with a flowmeter or a conventional valve with a pressure gauge to detect a low pressure. The actual hydrogen pressure for each sample is shown in Table 2. Through the first desorption process, the reverse phase transformation is induced to produce the recombined phase with good alignment of the crystallographic orientation consistent with the original $Fe_2$ B phase. Subsequently the second stage of desorption is carried out by the large exhauster until the vacuum pressure decreases under $10^{-4}$ torr, which results in eliminating the remanent hydrogen in the alloy.

TABLE 2

| No. | alloy | condition of first hydrogenation pressure | condition of second hydrogenation | relative reaction rate | hydrogen pressure atm | magnetic properties of magnet powder (BH) max | Br | iHc | anisotropic ratio | magnetic properties of bonded magnet (BH) max | Br |
|---|---|---|---|---|---|---|---|---|---|---|---|
| embodiment | | | | | | | | | | | |
| 1 | a | 1.0 atm | 825° C., 0.2 atm | 0.09 | 0.05 | 35 MGOe | 13.0 kG | 6.5 kOe | 0.81 | 17 MGOe | 9.1 kG |
| 2 | b | 1.0 atm | 825° C., 0.35 atm | 0.30 | 0.05 | 45 MGOe | 13.9 kG | 13.5 kOe | 0.87 | 22.5 MGOe | 10.3 kG |
| 3 | c | 0.5 atm | 825° C., 0.35 atm | 0.30 | 0.05 | 43 MGOe | 13.7 kG | 12.0 kOe | 0.85 | 21.0 MGOe | 10.1 kG |

TABLE 2-continued

| No. | alloy | condition of first hydrogenation pressure | condition of second hydrogenation | relative reaction rate | hydrogen pressure atm | magnetic properties of magnet powder (BH) max | Br | iHc | anisotropic ratio | magnetic properties of bonded magnet (BH) max | Br |
|---|---|---|---|---|---|---|---|---|---|---|---|
| 4 | d | 2 atm | 825° C., 0.35 atm | 0.30 | 0.05 | 45 MGOe | 14 kG | 13.2 kOe | 0.87 | 23 MGOe | 10.3 kG |
| 5 | e | 0.7 atm | 820° C., 0.30 atm | 0.22 | 0.05 | 41 MGOe | 13.5 kG | 13.8 kOe | 0.84 | 21.0 MGOe | 9.9 kG |
| 6 | f | 0.3 atm | 830° C., 0.30 atm | 0.26 | 0.05 | 44 MGOe | 13.7 kG | 13.0 kOe | 0.85 | 22.4 MGOe | 10.1 kG |
| 7 | g | 1.0 atm | 820° C., 0.35 atm | 0.27 | 0.05 | 39 MGOe | 13.0 kG | 14.2 kOe | 0.81 | 19.9 MGOe | 9.6 kG |
| 8 | h | 1.5 atm | 825° C., 0.35 atm | 0.30 | 0.05 | 43 MGOe | 13.5 kG | 13.7 kOe | 0.84 | 21.9 MGOe | 9.9 kG |
| 9 | i | 0.9 atm | 825° C., 0.30 atm | 0.24 | 0.05 | 42 MGOe | 13.4 kG | 13.2 kOe | 0.83 | 21.4 MGOe | 9.8 kG |
| comparative example | | | | | | | | | | | |
| 50 | b | — | 825° C., 0.35 atm | 0.30 | 0.05 | 36 MGOe | 13.2 kG | 11.7 kOe | 0.82 | 17 MGOe | 9.7 kG |
| 51 | b | 0.1 atm | 825° C., 0.35 atm | 0.30 | 0.05 | 37 MGOe | 13.3 kG | 12.6 kOe | 0.83 | 18 MGOe | 9.8 kG |
| 52 | b | vacuum (10-2 torr) | 825° C., 0.35 atm | 0.30 | 0.05 | 30 MGOe | 12.4 kG | 11.6 kOe | 0.77 | 15.4 MGOe | 9.0 kG |
| 53 | b | 1.0 atm | 825° C., 0.9 atm | 0.83 | 0.05 | 28.0 MGOe | 11.9 kG | 13.4 kOe | 0.74 | 15.0 MGOe | 8.8 kG |
| 54 | b | 0.5 atm | 825° C., 1.0 atm | 0.91 | 0.05 | 14 MGOe | 8.2 kG | 14.1 kOe | 0.51 | 7.1 MGOe | 6.0 kG |
| 55 | b | 0.3 atm | 825° C., 1.5 atm | 1.24 | 0.05 | 12.1 MGOe | 7.9 kG | 14.3 kOe | 0.49 | 6.2 MGOe | 5.5 kG |

After the second stage of desorption, the recombined NdFeB base alloy is conveyed to a cooling room and cooled down to room temperature under argon gas or vacuum. Finally the anisotropic NdFeB magnet powder is obtained.

This magnet powder is mixed with solid type epoxy resin of the ratio of 3 wt % and then is pressed in a die set at warm temperature under a magnetic field of 20 KOe by a press furnished with an electromagnet and heater. As a result, an anisotropic NdFeB bonded magnet is produced.

(Comparative Examples)

The samples of the magnet powder of No. 50–No. 55 with the composition of (b) in Table 1 is prepared as the comparative examples of No. 2, in the same way except under the individual conditions shown in Table 1. Subsequently, the anisotropic bonded magnets are produced from the samples of No. 50–No. 55 in the same way as the anisotropic bonded magnet of No. 2 sample.

Here, the magnet powder samples of No. 50 is produced in the absence of the first hydrogenation at a low temperature. The sample of No. 51 is produced under the condition that the hydrogen pressure of the first hydrogenation is less than that of the second hydrogenation. The sample of No. 52 is produced under the condition that the hydrogen pressure of the first hydrogenation is less than $10^{-2}$ torr. The sample of No. 53–55 is produced under the high hydrogen pressure of the second hydrogenation enough to make the large relative reaction ratio of more than 0.80.

(Estimation)

The magnet powder and the bonded magnet are estimated by the measurement of the magnetic property.

The maximum energy product, the residual induction and the coercivity of anisotropic magnet powders of a grain size of less than 212 $\mu$m are measured by a VSM (Vibrating Sample Magnetometer). On the other hand the maximum energy product and the residual induction of the anisotropic bonded magnet are measured by BH tracer. Table 2 shows the magnetic properties measured together.

It is seen that the magnet powder samples of No. 1–9 have the anisotropic ratio of more than 0.80 and the residual induction of more than 13 kG and the maximum product energy of more than 30 MGOe. The bonded magnets made from the samples of No. 1–9 respectively exhibit the residual induction of more than 9 kG and the maximum product energy of more than 16 MGOe.

While the comparative samples of No. 50–51 show the anisotropic ratios of 0.82 and 0.83 respectively that are nearly equal to 0.87 of No. 2, but show a decrease in the coercivity from No. 2 due to formation of umhomogeneous microstructure. The comparative samples of No. 52–53 show the anisotropic ratios of 0.77 and 0.74 respectively that are considerably reduced from 0.87 of No. 2. The comparative samples of No. 54–55 become the isotropic magnet powder.

Figure 3:
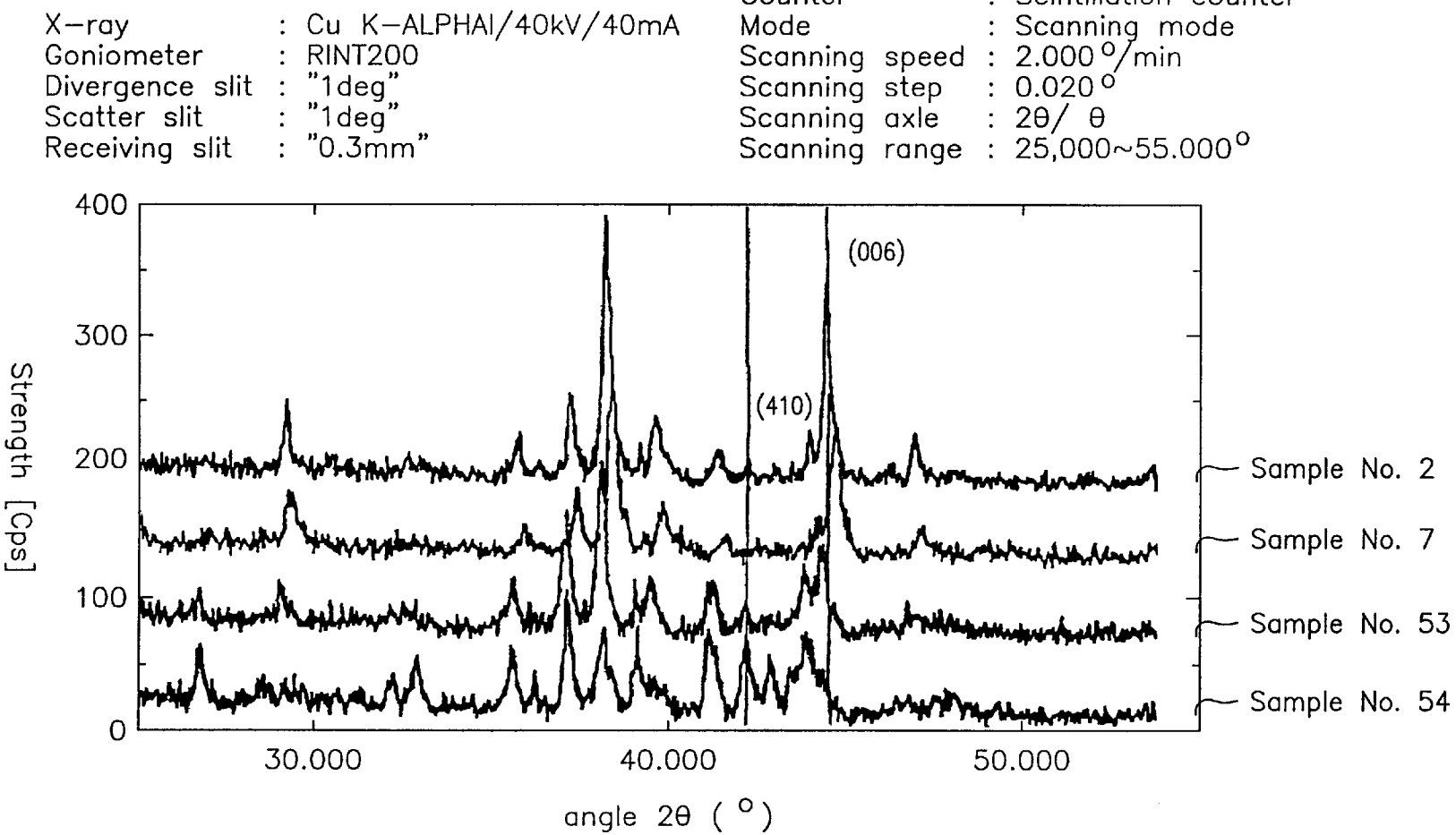
FIG. 3 is a chart showing the results of X ray analysis with four samples of RFeB base magnet powders.

Moreover, X ray diffraction is carried out to observe the S magnet powder samples of No. 2, 7, 53 and 54 after aligning the crystallographic orientation of the sample powders in the directions of the loaded external magnetic field. The anisotropic ratios of the samples observed are low in samples No. 2, 7, 53 and 54. The results are shown in FIG. 3. It is seen that the diffraction peak of the lattice plane of (006) increases in samples No. 2, 7, 53 and 54, while the diffraction peak of the lattice plane of (410) decreases in the same samples. The results mean that the ratio of (006) to (410) corresponds to the anisotropic ratio. The greater the ratio of (006) to (410), the more the anisotropy of the magnet powder.

The theoretical view of the result is as follows. The NdFeB based alloy has an isodiametric crystal with easy axis of the c-axis. Therefore, in the case that the crystallographic orientation of grains in polycrystalline is aligned in good order, that is, the anisotropic powder, the lattice plane of (006) shows strong diffraction peak, while the lattice plane of (410) shows weak diffraction peak in an X ray chart. The ratio of (006) to (410) shows a large value. In contrast, in the case of poor alignment, that is, for the isotropic powder, the lattice plane of (006) shows a decrease in a diffraction peak, while the lattice plane of (410) shows an increase in the diffraction peak. The ratio of (006) to (410) shows a small value.

Figure 4:
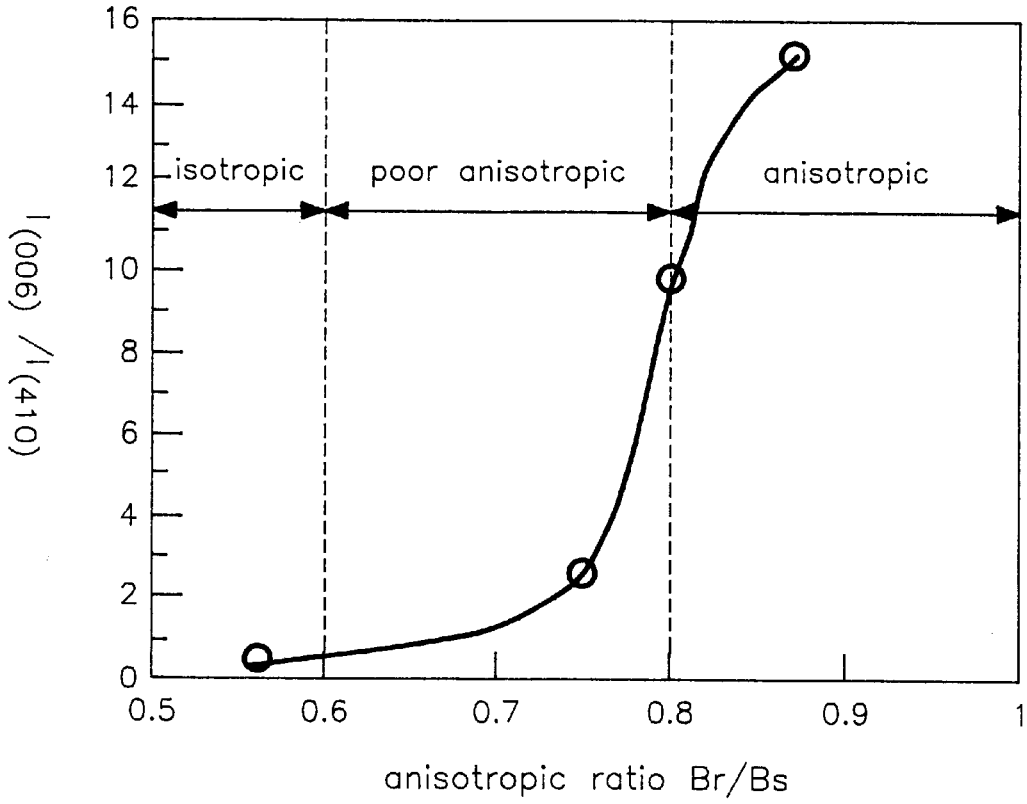
FIG. 4 is a graph showing the relationship between residual induction (Br) and the ratio of X ray diffraction strength of lattice plane of (006) to lattice plane of (410).

FIG. 4 shows the relationship between the diffraction strength ratio and the anisotropic ratio. From this figure it is understood that a good alignment of the crystallographic orientation produces a high anisotropic magnet powder.

Embodiment (2)

The anisotropic magnet powder is produced from an alloy of the composition (b) shown in Table 1. The production of embodiment (2) is carried out in the same way except the change of some reaction conditions of the reverse phase transformation. The changed conditions such as the hydrogen pressure, holding time and final vacuum are shown in Table 3. The reaction ratio of the reverse phase transformation also is shown in Table 3. The anisotropic bonded magnet is produced in the same way as embodiment (1) from the anisotropic magnet powder of samples of 10–16 and 56–59.

induction of more than 13 kG and the maximum product energy of more than 40 MGOE. The bonded magnets made from the samples of No. 10–16 respectively exhibit the residual induction of more than 9.6 kG and the maximum product energy of more than 21.0 MGOe.

While the comparative samples of No. 56 show the good coercivity of 13.5 KOe, but have a remarkable decrease in the anisotropic ratio to 0.76. The comparative samples of No. 57 and 59 are produced out of the suitable range of the reaction ratio of the reverse phase transformation to show a considerable decrease in the anisotropic ratio. The comparative samples of No. 58 are produced under the reaction ratio of 0.86 that is within the suitable range, but too long a holding time of the first stage of absorption causes the remarkable reduction in coercivity due to grain growth in spite of its high anisotropic ratio.

TABLE 3

| No. | alloy | control of first exhauster | hydrogen pressure of first description | relative reaction rate of the reverse phase trans-formation | hold-ing time | final vacuum | magnetic properties of anisotropic magnet powder (BH) max | Br | iHc | anisotropic ratio | magnetic properties of bonded magnet (BH) max | Br |
|---|---|---|---|---|---|---|---|---|---|---|---|---|
| embodiment | | | | | | | | | | | | |
| 10 | b | ○ | 0.05 atm | 0.39 | 30分 | 4 × 10-4 torr | 45 MGOe | 13.7 kG | 13.2 kOe | 0.85 | 22.5 MGOe | 10.1 kG |
| 11 | b | ○ | 0.001 atm | 0.86 | 40分 | 3 × 10-3 torr | 44 MGOe | 13.5 kG | 13.2 kOe | 0.84 | 22.1 MGOe | 9.9 kG |
| 12 | b | ○ | 0.003 atm | 0.80 | 60分 | 6 × 10-5 torr | 44 MGOe | 13.6 kG | 12.9 kOe | 0.87 | 22.0 MGOe | 9.9 kG |
| 13 | b | ○ | 0.05 atm | 0.39 | 45分 | 1 × 10-2 torr | 40 MGOe | 13.1 kG | 13.7 kOe | 0.81 | 20.8 MGOe | 9.6 kG |
| 14 | b | ○ | 0.01 atm | 0.70 | 35分 | 5 × 10-4 torr | 41 MGOe | 13.2 kG | 13.7 kOe | 0.82 | 21.3 MGOe | 9.7 kG |
| 15 | b | ○ | 0.07 atm | 0.29 | 60分 | 7 × 10-4 torr | 41 MGOe | 13.3 kG | 14.0 kOe | 0.83 | 21.1 MGOe | 9.8 kG |
| 16 | b | ○ | 0.09 atm | 0.21 | 50分 | 2 × 10-4 torr | 42 MGOe | 13.5 kG | 12.7 kOe | 0.84 | 22.1 MGOe | 9.9 kG |
| comparative example | | | | | | | | | | | | |
| 56 | b | X | — | | — | 4 × 10-3 torr | 34 MGOe | 12.2 kG | 13.5 kOe | 0.76 | 16.0 MGOe | 9.0 kG |
| 57 | b | ○ | 0.14 atm | 0.03 | 45分 | 5 × 10-4 torr | 34 MGOe | 12.7 kG | 12.4 kOe | 0.79 | 18.2 MGOe | 9.2 kG |
| 58 | b | ○ | 0.001 atm | 0.86 | 140分 | 4 × 10-4 torr | 35 MGOe | 13.2 kG | 9.4 kOe | 0.82 | 18.9 MGOe | 9.5 kG |
| 59 | b | ○ | 0.0005 atm | 1.17 | 45分 | 2 × 10-4 torr | 33 MGOe | 12.5 kG | 13.5 kOe | 0.78 | 117.8 MGOe | 9.2 kG |

○: with control
X: without controlmagnetic (Comparative Examples)

The samples of the magnet powder of No. 56–No. 59 with the composition of (b) in Table 1 is prepared in the same way as embodiment (2) except under the individual conditions shown in Table 1. Subsequently, the anisotropic bonded magnets are produced from the samples of No. 56–No. 59 in the same way as the anisotropic bonded magnet of embodiment (2). Here, the magnet powder sample of No. 56 is produced in the absence of the first stage of desorption. The sample of No. 57 is produced under the condition that the hydrogen pressure of the first stage of desorption is too high. The sample of No. 58 is produced under the condition that the holding time of the first stage of desorption is too long. The sample of No. 59 is produced under the low hydrogen pressure of the first stage of desorption.

(Estimation)

Similarly to the first embodiments, the magnet power and the bonded magnet of the second embodiments are estimated by the measurement of the magnetic property. Table 3 shows the magnetic properties measured together.

It s seen that the magnet powder samples of No. 10–16 have the anisotropic ratio of more than 0.80 and the residual Embodiment (3)

The anisotropic magnet powder is produced from an alloy of the composition (j-ee) shown in Table 1.

The details of the present hydrogen heat treatment are as follows:

The raw materials of a designated amount of elements shown in Table 1 are melted in the high frequency furnace and cast into 10 kg ingots of the compositions shown in Table 1. After that the ingots are homogenized in the same way as the first embodiments.

The homogenized ingots are crushed into coarse powder with average particle sizes of less than 10 mm, and are subject to the first hydrogenation, the second hydrogenation and desorption. The anisotropic bonded magnet is produced in the same way as production of embodiment (1) from the anisotropic magnet powder.

The magnet powder and the bonded magnet of the third embodiments are estimated by the measurement of the magnetic property. Table 4 shows the magnetic properties measured together.

TABLE 4

| No. | alloy | condition of first hydro-genation | condition of second hydro-genation | relative reaction rate of the phase trans-formation | relative reaction rate of the reverse phase trans-formation | magnetic properties of anisotropic anisotropic magnet powder (BH) max | Br | iHe | anisotropic ratio | Hk | magnetic properties of bonded magnet (BH) max | Br |
|---|---|---|---|---|---|---|---|---|---|---|---|---|
| embodiment | | | | | | | | | | | | |
| 17 | j | 0.5 atm | 820° C., 0.5 atm | 0.43 | 0.36 | 43.0 MGOe | 13.7 kG | 12.0 kOe | 0.85 | 0.5 | 21.5 MGOe | 10.1 kG |
| 18 | k | 0.6 atm | 820° C., 0.5 atm | 0.43 | 0.41 | 41.6 MGOe | 13.5 kG | 9.2 kOe | 0.84 | 0.48 | 20.8 MGOe | 10.0 kG |
| 19 | l | 0.5 atm | 815° C., 0.4 atm | 0.30 | 0.32 | 42.3 MGOe | 13.6 kG | 8.4 kOe | 0.85 | 0.48 | 21.1 MGOe | 10.0 kG |
| 20 | m | 0.6 atm | 800° C., 0.4 atm | 0.22 | 0.42 | 41.5 MGOe | 13.4 kG | 8.6 kOe | 0.84 | 0.48 | 20.2 MGOe | 9.8 kG |
| 21 | n | 0.7 atm | 810° C., 0.6 atm | 0.43 | 0.51 | 42.0 MGOe | 13.6 kG | 9.0 kOe | 0.85 | 0.49 | 20.4 MGOe | 10.0 kG |
| 22 | o | 1.0 atm | 825° C., 0.6 atm | 0.57 | 0.69 | 38.9 MGOe | 13.2 kG | 11.9 kOe | 0.82 | 0.45 | 19.2 MGOe | 9.7 kG |
| 23 | p | 0.8 atm | 820° C., 0.5 atm | 0.43 | 0.63 | 37.6 MGOe | 13.0 kG | 10.8 kOe | 0.81 | 0.42 | 18.9 MGOe | 9.6 kG |
| 24 | q | 0.5 atm | 820° C., 0.4 atm | 0.33 | 0.47 | 36.4 MGOe | 13.1 kG | 6.4 kOe | 0.81 | 0.41 | 18.0 MGOe | 9.7 kG |
| 25 | r | 0.5 atm | 820° C., 0.3 atm | 0.22 | 0.36 | 37.0 MGOe | 13.2 kG | 7.0 kOe | 0.82 | 0.41 | 18.6 MGOe | 9.7 kG |
| 26 | s | 0.5 atm | 820° C., 0.3 atm | 0.22 | 0.36 | 36.8 MGOe | 13.2 kG | 6.8 kOe | 0.82 | 0.42 | 18.4 MGOe | 9.8 kG |
| 27 | t | 0.8 atm | 820° C., 0.5 atm | 0.43 | 0.47 | 38.5 MGOe | 13.0 kG | 11.3 kOe | 0.81 | 0.43 | 19.1 MGOe | 9.6 kG |
| 28 | u | 0.5 atm | 820° C., 0.3 atm | 0.22 | 0.47 | 35.7 MGOe | 12.9 kG | 6.8 kOe | 0.80 | 0.42 | 17.8 MGOe | 9.5 kG |
| 29 | v | 0.5 atm | 820° C., 0.5 atm | 0.43 | 0.47 | 38.9 MGOe | 13.1 kG | 9.0 kOe | 0.82 | 0.43 | 19.3 MGOe | 9.7 kG |
| 30 | w | 0.5 atm | 820° C., 0.4 atm | 0.33 | 0.36 | 38.0 MGOe | 13.2 kG | 8.5 kOe | 0.82 | 0.42 | 19.1 MGOe | 9.7 kG |
| 31 | x | 0.5 atm | 820° C., 0.3 atm | 0.22 | 0.47 | 37.9 MGOe | 13.2 kG | 7.2 kOe | 0.82 | 0.43 | 18.5 MGOe | 9.6 kG |
| 32 | y | 0.4 atm | 820° C., 0.2 atm | 0.08 | 0.47 | 35.8 MGOe | 13.0 kG | 6.2 kOe | 0.81 | 0.42 | 17.3 MGOe | 9.5 kG |
| 33 | z | 0.7 atm | 800° C., 0.6 atm | 0.35 | 0.31 | 40.5 MGOe | 13.5 kG | 11.9 kOe | 0.84 | 0.45 | 20.0 MGOe | 10.0 kG |
| 34 | aa | 0.5 atm | 820° C., 0.4 atm | 0.33 | 0.47 | 35.7 MGOe | 12.8 kG | 6.7 kOe | 0.80 | 0.40 | 17.5 MGOe | 9.4 kG |
| 35 | bb | 0.8 atm | 820° C., 0.4 atm | 0.33 | 0.36 | 35.5 MGOe | 12.8 kG | 6.5 kOe | 0.80 | 0.40 | 17.5 MGOe | 9.4 kG |
| 36 | cc | 1.0 atm | 820° C., 0.4 atm | 0.33 | 0.47 | 36.4 MGOe | 13.0 kG | 6.5 kOe | 0.81 | 0.42 | 18.3 MGOe | 9.6 kG |
| 37 | dd | 0.5 atm | 820° C., 0.4 atm | 0.33 | 0.47 | 41.3 MGOe | 13.5 kG | 13.0 kOe | 0.84 | 0.46 | 20.7 MGOe | 10.1 kG |
| 38 | ee | 0.5 atm | 820° C., 0.4 atm | 0.33 | 0.47 | 41.0 MGOe | 13.5 kG | 12.5 kOe | 0.84 | 0.46 | 20.4 MGOe | 10.0 kG |

It is found that one or more additions of Al, Si, Ti, Cr, Mn, Co, Ni, Cu, Ge, Zr, Mo, In, Sn, Hf, Ta, W or Pb have an effect on the coercivity and the aspect ratio (Hk/iHc), where Hk means an external magnetic field when the residual induction shows a decrease of 10%.

What is claimed is:

1. A method of producing an anisotropic magnet powder comprising the following sequential steps:

a) hydrogenating an RFeB based alloy, comprising from 11 to 15 at % of a rare earth element (R), from 5.5 to 8.0 at % of boron (B), iron (Fe) and unavoidable impurity, to produce a hydride $R_2Fe_{14}BH_x$ (x: atomic ratio of hydrogen), by reacting the RFeB based alloy with hydrogen at a temperature of less than 600° C. under a hydrogen atmosphere;

b) heating the product of step (a) up to a temperature in the range of from 760° to 860° C. under a hydrogen gas atmosphere of from 0.2 to 0.6 atm to effect phase transformation at a relative reaction rate Vr1, having a value of from 0.05 to 0.80, wherein:

$$Vr1=1/0.576\cdot[\{(P_{H2})^{1/2}-0.39\}/0.61]\cdot\exp(-Ea/RT)\times10^{-9}$$

Wherein $P_{H2}$: hydrogen gas pressure (Pa)

Ea: activation energy of alloy (J/molK)

R: Gas constant

T: Absolute temperature (K)

c) effecting desorption including (i) a first stage comprising heating the product of step (b) under a hydrogen gas pressure of from 0.1 to 0.001 atm to react said product with hydrogen at a relative speed range of a reverse phase transformation in which a relative reaction rate Vr2 has a value of from 0.10 to 0.95, wherein:

$$Vr2=[1/0.576\cdot\{0.39-(P_{H2})^{1/2}/0.38\}\cdot\exp(-Ea/RT)\times10^{-9}$$

and ii) a second stage comprising desorbing hydrogen from the RFeB based alloy produced from the first stage until the hydrogen pressure is less than $10^{-2}$ torr.

2. A method according to claim 1 wherein the RFeB based alloy consists essentially of R, B, Fe and unavoidable impurity.

3. A method according to claim 1 wherein the RFeB based alloy comprises one or two kinds of at least one member selected from the group consisting of from 0.01 to 0.1 at % of Ga and from 0.01 to 0.6 at % of Nb.

4. A method according to claim 1 wherein the RFeB based alloy comprises a total of from 0.001 to 5.0 at % of at least one kind of at least one member selected from the group consisting of Al, Si, Ti, V, Cr, Mn, Ni, Cu, Ge, Zr, Mo, In, Sn, Hf, Ta, W and Pb.

5. A method according to claim 3 wherein the RFeB based alloy comprises a total of from 0.001 to 5.0 at % of at least one kind of at least one member selected from the group consisting of Al, Si, Ti, V, Cr, Mn, Ni, Cu, Ge, Zr, Mo, In, Sn, Hf, Ta, W and Pb.

6. A method of producing an anisotropic magnet powder comprising the following sequential steps:

a) hydrogenating an RFeB based alloy, comprising from 11 to 15 at % of a rare earth element (R), from 5.5 to 8.0 at % of boron (B), iron (Fe) and unavoidable impurity, to produce a hydride $R_2Fe_{14}BH_x$ (x: atomic ratio of hydrogen), by reacting the RFeB based alloy with hydrogen at a temperature of less than 600° C. under a hydrogen atmosphere;

b) heating the hydride product of step (a) up to a temperature in the range of from 760° to 860° C. under a hydrogen gas atmosphere of from 0.2 to 0.6 atm to react it further with hydrogen and cause a phase transformation (decomposition of the hydride to an $RH_2$ phase, an Fe phase and an $Fe_2B$ phase), the phase transformation reaction proceeding at a relative reaction rate Vr1 of from 05 to 0.80, wherein:

$$Vr1=1/0.576\cdot[\{(P_{H2})^{1/2}-0.39\}/0.61]\cdot\exp(-Ea/RT)\times10^{-9}$$

Wherein:
$P_{H2}$:hydrogen gas pressure (Pa)
Ea: activation energy of alloy (J/molK)
R: Gas constant
T: Absolute temperature (K)

c) effecting desorption including i) a first stage comprising heating the products of step (b) under a hydrogen gas pressure of from 0.1 to 0.001 atm and thus reacting said products with hydrogen and causing a reverse phase transformation (changing from the three decomposed phases to $R_2Fe_{14}BH_x$ by desorption), the reverse phase transformation reaction proceeding at a relative reaction rate Vr2 of from 0.10 to 0.95, wherein:

$$Vr2=[1/0.576\cdot\{0.39-(P_{H2})^{1/2}\}/0.38]\cdot\exp(-Ea/RT)\times10^{-9}$$

and ii) a second stage comprising desorbing hydrogen from the $R_2Fel_4BH_x$ until the hydrogen pressure is less than $10^{-2}$ torr.

7. A method according to claim 6 wherein the RFeB based alloy consists essentially of R, B, Fe and unavoidable impurity.

8. A method according to claim 6 wherein the RFeB based alloy comprises one or two kinds of at least one member selected from the group consisting of from 0.01 to 0.1 at % of Ga and from 0.01 to 0.6 at % of Nb.

9. A method according to claim 6 wherein the RFeB based alloy comprises a total of from 0.001 to 5.0 at % of at least one kind of at least one member selected from the group consisting of Al, Si, Ti, V, Cr, Mn, Ni, Cu, Ge, Zr, Mo, In, Sn, Hf, Ta, W and Pb.

10. A method according to claim 8 wherein the RFeB based alloy comprises a total of from 0.001 to 5.0 at % of at least one kind of at least one member selected from the group consisting of Al, Si, Ti, V, Cr, Mn, Ni, Cu, Ge, Zr, Mo, In, Sn, Hf, Ta, W and Pb.

11. A method of producing an anisotropic magnet powder comprising the following sequential steps:

a) hydrogenating an RFeB based alloy, comprising from 11 to 15 at % of a rare earth element (R), from 5.5 to 8.0 at % of boron (B), iron (Fe) and unavoidable impurity as starting material, to produce a hydride $R_2Fe_{14}BH_x$ (x: atomic ratio of hydrogen), by reacting the RFeB based alloy with hydrogen at a temperature of less than 600° C. under a hydrogen atmosphere less than 1.0 atm necessary for hydrogenation;

b) further hydrogenating the hydride product from step (a) to produce a mixture of an $RH_2$ phase, an Fe phase and an $Fe_2B$ phase and to make crystallographic orientation of the $Fe_2B$ phase consistent with that of $R_2Fe_{14}BH_x$ by effecting a phase transformation with heating said hydride up to a phase transformation temperature in the range of from 760° to 860° C. under a hydrogen atmosphere of from 0.2 to 0.6 atm at a relative phase transformation speed with a relative reaction rate Vrl within the range of from 0.05 to 0.80, wherein:

$$Vr1=[1/0.576\cdot\{(P_{H2})^{1/2}-0.39\}/0.61]\cdot\exp(-Ea/RT)\times10^{-9}$$

Wherein:
$PH_2$: hydrogen gas pressure (Pa)
Ea: activation energy of alloy (J/molK)
R: Gas constant
T: Absolute temperature (K); and c) effecting desorption, including i) a first stage comprising effecting a reverse phase transformation of the mixture by desorbing hydrogen from the $RH_2$ while controlling relative phase transformation speed so that a relative reaction rate Vr2 has a value of from 0.10 to 0.95 at a temperature in the range of from 760° to 860° C. under a hydrogen atmosphere of from 0.1 to 0.001 atm, and producing a fine grained recombined hydride $R_2Fe_{14}BH_x$ having a crystallographic orientation consistent with that of the $Fe_2B$ phase, wherein:

$$Vr2=[1/0.576\cdot\{0.39-(P_{H2})^{1/2}\}/0.38]\cdot\exp(-Ea/RT)\times10^{-9}$$

and ii) a second stage comprising desorbing hydrogen from the recombined hydride $R_2Fe_{14}BH_x$ until hydrogen pressure becomes less than $10^{-2}$ torr to produce the fine grained $R_2Fe_{14}BH_x$ phase.

12. A method according to claim 11 wherein the RFeB based alloy consists essentially of R, B, Fe and unavoidable impurity.

13. A method of producing an anisotropic magnet powder comprising the following sequential steps:

a) hydrogenating an RFeB based alloy, comprising from 11 to 15 at % of a rare earth element (R), from 5.5 to 8.0 at % of boron (B), iron (Fe), up to 20 at % of Co and unavoidable impurity, to produce a hydride $R_2Fe_{14}BH_x$ (x: atomic ratio of hydrogen), by reacting the RFeB based alloy with hydrogen at a temperature of less than 600° C. under a hydrogen atmosphere;

b) heating the product of step (a) up to a temperature in the range of from 760° to 800° C. under a hydrogen gas atmosphere of from 0.2 to 0.6 atm to effect phase transformation at a relative reaction rate Vr1, having a value of from 0.05 to 0.80, wherein:

$$Vr1=1/0.576\cdot[\{P_{H2}-0.39\}/0.61]\cdot\exp(-Ea/RT)\times10^{-9}$$

Wherein:
$P_{H2}$: hydrogen gas pressure (Pa)
Ea: activation energy of allow (J/molk)
R: Gas constant
T: Absolute temperature (K)

c) effecting desorption including (i) a first stage comprising heating the product of step (b) under a hydrogen gas pressure of from 0.1 to 0.001 atm to react said product with hydrogen at a relative speed range of a reverse phas4e transformation in which a relative reaction rate Vr2 has a value of from 0.10 to 0.95, wherein:

$$Vr2=[1/0.576\cdot\{0.39-(P_{H2})^{1/2}/0.38\}\cdot\exp(-Ea/RT)\times10^{-9}$$

and (ii) a second stage comprising desorbing hydrogen from the RFeB based alloy produced from the first stage until the hydrogen pressure is less than $10^{-2}$ torr.

14. A method according to claim 13 wherein the RFeB based alloy comprises one or two kinds of at least one member selected from the group consisting of from 0.01 to 0.1 at % of Ga and from 0.01 to 0.6 at % of Nb.

15. A method according to claim 13 wherein the RFeB based alloy comprises a total of from 0.001 to 5.0 at % of at least one kind of at least one member selected from the group consisting of Al, Si, Ti, V, Cr, Mn, Ni, Cu, Ge, Zr, Mo, In, Sn, Hf, Ta, W and Pb.

16. A method according to claim 14 wherein the RFeB based alloy comprises a total of from 0.001 to 5.0 at % of at least one kind of at least one member selected from the group consisting of Al, Si, Ti, V, Cr, Mn, Ni, Cu, Ge, Zr, Mo, In, Sn, Hf, Ta, W and Pb.

* * * * *